United States Patent [19]

Kodama et al.

[11] Patent Number: 4,961,024

[45] Date of Patent: Oct. 2, 1990

[54] CIRCULAR FLUORESCENT LAMP WITH OVAL SECTION OF TUBE

[75] Inventors: Churyo Kodama, Tokyo; Yasuo Hirasawa, Ome; Yukio Ohno, Akishima, all of Japan

[73] Assignee: Hitachi, Ltd., Tokyo, Japan

[21] Appl. No.: 211,246

[22] Filed: Jun. 24, 1988

[30] Foreign Application Priority Data

Jun. 26, 1987 [JP] Japan ..... 62-157615

[51] Int. Cl.[5] ..... H01J 61/30; H01J 63/02

[52] U.S. Cl. ..... 313/493; 313/611; 313/612; 313/634; 220/2.1 R

[58] Field of Search ..... 313/493, 573, 634, 609, 313/611, 612; 220/2.1 R; 445/22, 26

[56] References Cited

U.S. PATENT DOCUMENTS

| | | | |
|---|---|---|---|
| 1,794,343 | 2/1931 | Smalley | 313/611 X |
| 2,267,118 | 12/1941 | Marder | 313/493 X |
| 3,514,276 | 5/1970 | Fujio et al. | 313/493 X |

FOREIGN PATENT DOCUMENTS

| | | | |
|---|---|---|---|
| 37-22455 | 12/1962 | Japan . | |
| 50-32785 | 10/1975 | Japan . | |
| 51-11876 | 4/1976 | Japan . | |
| 81753 | 4/1988 | Japan | 313/634 |

*Primary Examiner*—Donald J. Yusko
*Assistant Examiner*—Michael Horabik
*Attorney, Agent, or Firm*—Fay, Sharpe, Beall, Fagan, Minnich & McKee

[57] ABSTRACT

A circular fluorescent lamp has a fluorescent tube of a generally circular shape having electrodes fixed gas-tight in both of its ends respectively to enclose inert gas and mercury therein. A cap is mounted to bridge between the tube ends. The fluorescent tube has an oval section taken along a line perpendicular with respect to its axis. The rate of ovalness y/x, representing the ratio between the larger tube diameter y and the smaller tube diameter x of the tube sectional shape, preferably lies within the range of 1.10 to 1.30.

4 Claims, 1 Drawing Sheet

CIRCULAR FLUORESCENT LAMP WITH OVAL SECTION OF TUBE

BACKGROUND OF THE INVENTION

The invention relates to a discharge lamp having an oval sectional shape, and more particularly to a circular fluorescent lamp.

Research and studies for developing a circular fluorescent lamp having a non-circular sectional started many years ago for the purpose of increasing the illuminance of the lamp on a plane beneath its installed position, as disclosed in Japanese Patent Publications Nos. 50-32785 (1975) and 51-11876 (1976). Also, Japanese Utility Model Publication No. 37-22455 (1962) proposes a straight fluorescent lamp in which the ratio between the larger and smaller tube diameters is selected to be 4:3 or 4:2, and the thickness of its phosphor film is made non-uniform, so as to improve its illuminance in a specific direction relative to its installation.

Although a discharge tube having an oval sectional shape has been proposed for years and is well known in the art, as disclosed in the prior art publications, the mechanical strength of the discharge tube decreases inevitably due its oval sectional shape. However, no proposal has been made hitherto for solving the problem of an undesirable decrease in the mechanical strength of such a discharge tube.

SUMMARY OF THE INVENTION

It is an object of the present invention to provide a circular fluorescent lamp having a tube with an oval section, which has a mechanical strength high enough to withstand the highest possible highest pressure of ambient air in spite of its oval sectional shape.

According to the present invention which attains the above object, there is provided a circular fluorescent lamp having a fluorescent tube of a generally circular shape having electrodes fixed gastight in both ends thereof respectively and enclosing inert gas and mercury therein. The lamp has a cap mounted to bridge between the tube ends. Preferably the fluorescent tube is sized so that, when sectioned along a line perpendicular with respect to the tube axis, the rate of ovalness y/x representing the ratio between the larger tube diameter y and the smaller tube diameter x of the tube sectional shape lies within the range of 1.10 to 1.30.

It is preferable that the fluorescent tube has an oval sectional shape in a range excluding the tube ends and the cap, and that the range has a central angle $\theta$ of at least 270°.

Also, the larger tube diameter y is preferably 30 to 34 mm, and the smaller tube diameter x is preferably 25 to 29 mm.

Further, the contour of the wall of the fluorescent tube forming the larger tube diameter y is preferably generally flat or convex.

DESCRIPTION OF THE PREFERRED EMBODIMENTS

Figure 1:
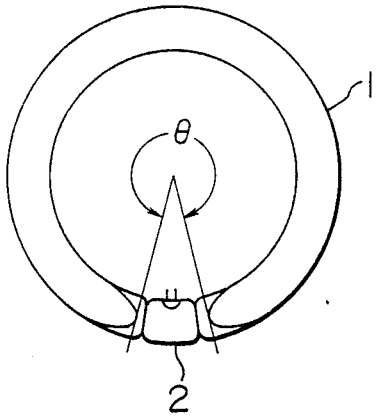
FIG. 1 is a plan view of an embodiment of the circular fluorescent lamp according to the present invention.

First, the basic concept of the present invention will be described.

The premise of the circular fluorescent lamp according to the present invention is that the circular fluorescent lamp is adaptable to any one of existing luminaires and completely compatible with any one of many existing circular fluorescent lamps. Therefore, the circular fluorescent lamp of the present invention is required to satisfy not only the starting characteristic but also the feasibility of installation or mounting. A further requirement of the circular fluorescent lamp of the present invention is that the illuminance on a plane beneath its installed position is increased over that of a conventional circular fluorescent lamp having a circular sectional shape.

To evaluate the mechanical strength of such a circular fluorescent lamp, the circular fluorescent lamp is tested according to a known method wherein it is required to withstand an air pressure of 3 kg/cm$^2$ (an absolute pressure of 4 kg/cm$^2$). The safety of the circular fluorescent lamp during actual usage or handling cannot be ensured when if the lamp cannot withstand such an air pressure. The factors affecting the mechanical strength of the discharge tube of the circular fluorescent lamp of the present invention include the sectional shape of the oval tube portion, the rate of ovalness representing the ratio between the larger tube diameter and the smaller tube diameter of the sectional shape, and the glass wall thickness of the discharge tube. In a conventional circular fluorescent lamp commonly available in the market, the ratio y/x between the larger diameter y and the smaller diameter x of its section lies within the range of y/x=0.95 to 1.05, that is, the discharge tube has a generally circular sectional shape. The discharge tube has a glass wall thickness of 0.6 to 1.1 mm, and its mechanical strength is measured in the air pressure test is about 10 kg/cm$^2$ which is a sufficiently large value. On the other hand, for a conventional circular fluorescent lamp with an oval section, its larger rate of ovalness, and its mechanical strength as measured in the air smaller, and the mechanical strength against the air pressure test decreases correspondingly.

Although a lamp's mechanical strength against air pressure was not considered so important hitherto, an attempt has been made to experimentally find the strength so as to secure the safety of the fluorescent lamp during practical use. The internal pressure of the discharge tube is nearly equal to a vacuum, and an external pressure of one atmosphere is always imparted to the discharge tube. In addition to the external air pressure described above, various external forces are imparted to the discharge tube during practical use. These external forces include an impact imparted from a lamp holder at the time of installing the discharge tube on the holder, a pressure imparted from the lamp holder holding the discharge tube, and various other impacts imparted to the discharge tube during handling. When the relationship between the endurance against these external forces and the results of an air pressure test on the discharge tube are detected, the rate of ovalness can be determined on the basis of the mechanical strength against air pressure. Therefore, an installing test of repeatedly installing the discharge tube on the lamp holder and a drop test of dropping steel balls on the discharge tube were conducted to detect the relationship between the results of these tests and the results of the air pressure test. As a result, it has been found that, when the discharge tube can withstand an air pressure of 3 kg/cm$^2$, the discharge tube can substantially satisfy the practical strength requirements of the various tests described above.

An air pressure test was conducted on oval-section circular fluorescent lamps whose discharge tubes had various oval sectional shapes and glass wall thicknesses. The results of the air pressure test proved that the discharge tube having a glass wall thickness of 0.7 mm was destroyed at an air pressure of 3 kg/cm$^2$ when the rate of ovalness was larger than 1.3, and the desired safety of the product could not be secured. Thus, the discharge tube is required to have its glass wall thickness larger than at least 0.7 mm so as to ensure the efficiency of production in the process for manufacturing circular fluorescent lamps.

Further, as described later, it has been found that the illuminance on a plane beneath an installed position of the oval-section circular fluorescent lamp cannot be improved by 5% or more than that of a conventional circular-section circular fluorescent lamp, unless the rate of ovalness is equal to or larger than 1.1. Therefore, it is most preferable that the rate of ovalness lies within the range of 1.1 to 1.3.

Preferred embodiments of the present invention will now be described with reference to the drawings.

FIG. 1 is a plan view of the circular fluorescent lamp according to the present invention.

The circular fluorescent lamp embodying the present invention is intended to correspond to circular fluorescent lamps Type FCL30 and Type FCL30/32 among those specified in Class C7601 of the Japanese Industrial Standards, although its discharge tube has an oval sectional shape. Therefore, the discharge tube 1 must have tube diameters which satisfy the specified values of 31±5 mm and 29±4 mm respectively.

Figure 2:
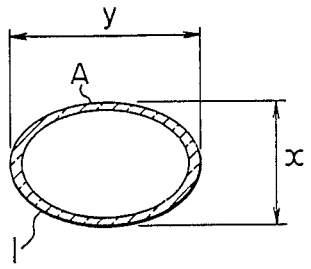
FIG. 2 is a vertical sectional view of the discharge tube used in the embodiment of the present invention.

As is commonly known, electrodes are fixed gastight in both ends respectively of the fluorescent tube 1, and inert gas at 2 to 3 Torr is enclosed together with a suitable quantity of mercury in the internal space of the fluorescent tube 1. The fluorescent tube 1 is formed into a circular shape, and a phosphor film is coated on the inner wall of glass. A cap 2 is mounted to bridge between the ends of the fluorescent tube 1. Of course, the fluorescent tube 1 has an oval sectional shape when sectioned along a line perpendicular with respect to the tube axis. Such an oval sectional shape is shown in FIG. 2 in which y and x represent the larger and smaller tube diameters respectively. Six circular fluorescent lamps having various values of y/x, that is, 1.0, 1.1, 1.2, 1.3, 1.4 and 1.5, were manufactured for the purpose of testing them. Table 1 shows the dimensions of these trial-manufactured circular fluorescent lamps.

TABLE 1

| | Inner diameter of circular lamp | Larger tube diameter y | Smaller tube diameter x | y/x | Range of oval section θ |
|---|---|---|---|---|---|
| No. 1 | 165 mm ϕ | 31.0 mm | 31.0 mm | 1.0 | 300° |

TABLE 1-continued

| | Inner diameter of circular lamp | Larger tube diameter y | Smaller tube diameter x | y/x | Range of oval section θ |
|---|---|---|---|---|---|
| No. 2 | " | 32.0 mm | 29.0 mm | 1.1 | " |
| No. 3 | " | 33.0 mm | 27.5 mm | 1.2 | " |
| No. 4 | " | 34.0 mm | 26.0 mm | 1.3 | " |
| No. 5 | " | 35.0 mm | 25.0 mm | 1.4 | " |
| No. 6 | " | 36.0 mm | 24.0 mm | 1.5 | " |

Figure 3:
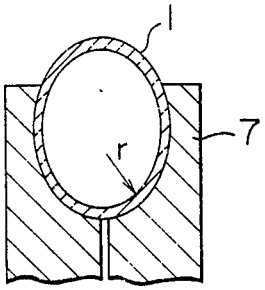
FIG. 3 shows the shape of a winding drum of a bending machine used for manufacturing the embodiment of the present invention.

A method of making these circular fluorescent lamps whose discharge tubes 1 have an oval sectional shape will now be described. Glass tubes prepared to form the discharge tubes 1 of the circular fluorescent lamps Nos. 1 to 6 had diameters of 31.0 mm, 29.0 mm, 27.5 mm, 26.0 mm, 25.0 mm and 24.0 mm respectively. After fixing a mount including an electrode in each of both ends of each of these glass tubes, the glass tubes were softened by heating in an oven and wound on a winding drum to manufacture the circular fluorescent lamps. The shape of the winding drum was as shown at 7 in FIG. 3. The curvature of the portion of the winding drum in contact with the glass tube, especially, the radius r of the curved portion corresponding to the end portion of the larger diameter y for each of the circular fluorescent lamps Nos. 1 to 6 was set at 15.5 mm, 14.5 mm, 13.8 mm, 13 mm, 12.5 mm and 12 mm respectively, thereby initially determining the dimension of the smaller tube diameter x of each of the oval sectional shapes. As for the dimension of the larger tube diameter y of each of the oval sectional shapes, $N_2$ gas at a pressure higher than 1 atm was enclosed in each of the glass tubes 1 during bending so as to inflate the larger tube diameter portion of each of the glass tubes 1 until the predetermined dimension is reached. Table 2 shows the results of an evaluation of the performance of the circular fluorescent lamps formed by the above method and shows also the results of the combination with existing luminaires.

TABLE 2

| | Luminous flux | Relative illuminance | Starting characteristic | Installability on existing luminaire |
|---|---|---|---|---|
| No. 1 | 1850 lm | 100 | o | o |
| No. 2 | 1860 lm | 105 | o | o |
| No. 3 | 1865 lm | 110 | o | o |
| No. 4 | 1855 lm | 115 | o | o |
| No. 5 | 1850 lm | 119 | o | o |
| No. 6 | 1840 lm | 122 | x | x |

Figure 4:
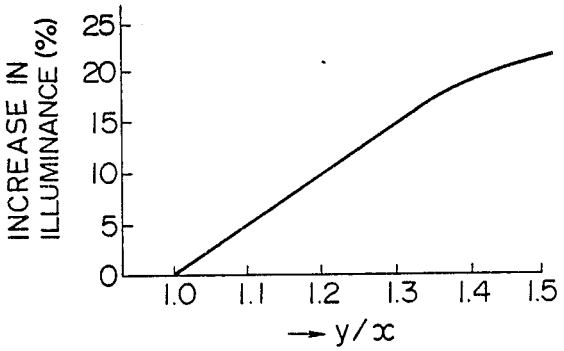
FIG. 4 is a graph showing the relation between the rate of ovalness y/x and a percentage increase of illuminance.

From the above results, it has been confirmed that, since at least a 5% increase in the illuminance of the lamp is essentially required to attain the desired effect of improving the illuminance, the ratio y/x should be equal to or larger than 1.1 as shown in FIG. 4. It has been further found that, since a high starting voltage is required when the dimension of the smaller tube diameter x is excessively small, the circular fluorescent lamp No. 6 cannot be put into practical use. This is because the value of x is x=24 mm, and a high starting voltage higher than 95 V is required. It has further been found that, when the larger tube diameter y is equal to or larger than 36 mm, the circular fluorescent lamp cannot be successfully installed on an existing luminaire, and the possibility of its practical use is not expected. The test results described above have proved that satisfactory results can be obtained when the value of the ratio y/x is equal to or larger than 1.1 but equal to or smaller than 1.4.

Figure 5:
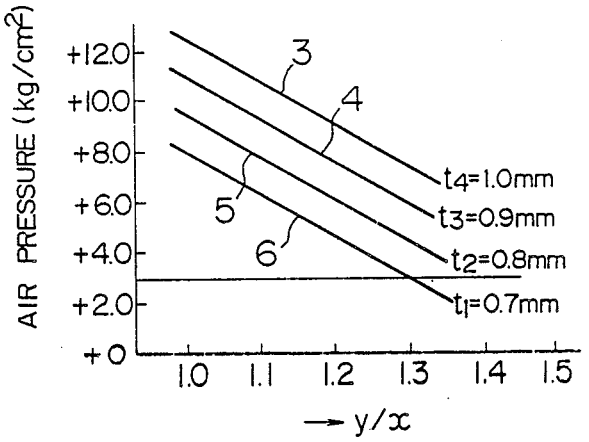
FIG. 5 is a graph showing the relation between the rate of ovalness and the mechanical strength of the discharge tube.

A safety evaluation test was conducted on the circular fluorescent lamps Nos. 1 to 6, and in this test, an air-pressure endurable limit of the circular fluorescent lamps was detected for the purpose of a safety evaluation. FIG. 5 shows the results of the safety evaluation test in which the circular fluorescent lamps Nos. 1 to 6 having the y/x ratios of 1.0, 1.1, 1.2, 1.3, 1.4 and 1.5 respectively were used, and the glass wall thickness $t_n$ of the discharge tube was changed to various values, that is, $t_1=0.7$ mm, $t_2=0.8$ mm, $t_3=0.9$ mm and $t_4=1.0$ mm. The test results have proved that the value of the ratio y/x of the oval sectional shape that can withstand an air pressure of 3 kg/cm$^2$, when the glass wall thickness of the discharge tube is 0.7 mm, is equal to or smaller than 1.3. That is, when the ratio y/x is selected to be $y/x<1.3$, the safety of the oval-section circular fluorescent lamp can be sufficiently maintained even when an impact is imparted at the time of installation, and even in a steel-ball drop test. The glass wall thickness of the discharge tube is selected at the value of 0.7 mm so as to ensure the efficiency of production in the manufacturing process as described already.

Therefore, when the starting voltage, the compatibility with existing luminaires and the results of safety evaluation of the oval-section circular fluorescent lamp are taken into account, the larger tube diameter y and the smaller tube diameter x should most preferably be y=30 to 34 mm, and x=25 to 29 mm.

The discharge tube 1 has its oval sectional shape over the range of its central angle $\theta$ of at least 270° (FIG. 1) which does not include the tube ends or the cap 2. The tube portions near the tube ends are not made oval in section because of the requirement for facilitating the lamp manufacture. The contour of the middle area A (FIG. 2) of the tube circumference providing the larger tube diameter y of the oval sectional shape of the discharge tube 1 is preferably generally flat or convex so as to maintain the required mechanical strength. It has been confirmed that, when the contour of the middle area A is conversely concave, the withstandable characteristic curves shown in FIG. 5 change greatly, and the air-pressure withstandable levels are greatly lowered.

It will be understood from the foregoing detailed description that the present invention provides a circular fluorescent lamp with an oval section having a rate of ovalness y/x that is selected to lie within the range of 1.10 to 1.30, so that the illuminance on an illuminated plane parallel to the circular fluorescent lamp can be improved by 5% or more as compared to that of a conventional circular fluorescent lamp having a circular section. Further, the circular fluorescent lamp of the present invention has a mechanical strength which can sufficiently withstand the pressure of air during practical use and is compatible with an existing circular fluorescent lamp.

We claim:

1. A circular fluorescent lamp, comprising:

a fluorescent tube of a generally circular shape having electrodes fixed in both ends thereof respectively and enclosing inert gas and mercury therein, and a cap mounted to bridge between said tube ends, said fluorescent tube having an oval sectional shape relative to a line perpendicular with respect to the tube axis, wherein the oval sectional shape has a rate of ovalness y/x representing the ratio between a larger tube diameter y and a smaller tube diameter x of the oval sectional shape that lies within the range of 1.10 to 1.30, and wherein said larger tube diameter y is in the range of 30 to 34 mm, said smaller tube diameter x is in the range of 25 to 29 mm, and said fluorescent tube has a thickness in the range of 0.7 to 1.0 mm.

2. A circular fluorescent lamp according to claim 1, wherein said fluorescent tube has said oval sectional shape in a range excluding said tube ends and said cap, and said range has a central angle $\theta$ of at least 270°.

3. A circular fluorescent lamp according to claim 1, wherein said fluorescent tube has a wall forming said larger tube diameter y that is generally flat.

4. A circular fluorescent lamp according to claim 1, wherein said fluorescent tube has a wall forming said larger tube diameter y that is convex.

* * * * *